US008773265B2

(12) United States Patent
Marr

(10) Patent No.: US 8,773,265 B2
(45) Date of Patent: Jul. 8, 2014

(54) ALARM APPARATUS AND METHOD

(75) Inventor: William Marr, Dunfermline (GB)

(73) Assignee: Sonis Europe Limited, Fife (GB)

( * ) Notice: Subject to any disclaimer, the term of this patent is extended or adjusted under 35 U.S.C. 154(b) by 613 days.

(21) Appl. No.: 12/611,197

(22) Filed: Nov. 3, 2009

(65) Prior Publication Data

US 2010/0109869 A1 May 6, 2010

(30) Foreign Application Priority Data

Nov. 3, 2008 (GB) ..... 0820143.6

(51) Int. Cl.
*G08B 13/00* (2006.01)

(52) U.S. Cl.
USPC ..... 340/566

(58) Field of Classification Search
USPC ..... 340/566, 506, 541, 545.1, 692; 367/135, 140
See application file for complete search history.

(56) References Cited

U.S. PATENT DOCUMENTS

| | | | | | |
|---|---|---|---|---|---|
| 4,060,803 | A * | 11/1977 | Ashworth, Jr. | ..... | 340/506 |
| 4,755,792 | A * | 7/1988 | Pezzolo et al. | ..... | 340/538 |
| 5,515,029 | A * | 5/1996 | Zhevelev et al. | ..... | 340/544 |
| 6,822,929 | B1 * | 11/2004 | Schubert et al. | ..... | 367/181 |
| 7,262,690 | B2 * | 8/2007 | Heaton et al. | ..... | 340/500 |
| 8,018,337 | B2 * | 9/2011 | Jones et al. | ..... | 340/539.14 |
| 2005/0253713 | A1 * | 11/2005 | Yokota | ..... | 340/566 |
| 2008/0111706 | A1 | 5/2008 | Morris | | |
| 2008/0162133 | A1 | 7/2008 | Couper et al. | | |
| 2009/0033505 | A1 * | 2/2009 | Jones et al. | ..... | 340/584 |

OTHER PUBLICATIONS

European Search Report for European Application No. 09174517.4 (Feb. 26, 2010).

* cited by examiner

*Primary Examiner* — Phung Nguyen
(74) *Attorney, Agent, or Firm* — Jenkins, Wilson, Taylor & Hunt, P.A.

(57) ABSTRACT

An alarm system for protecting an environment from an unwanted events, such as an intrusion, the alarm system including: a detection sensor for detecting sound in the environment, wherein the detection sensors are adaptable to identify a unique audio signal if an unwanted event is detected; a sensor module adapted to verify the unique audio signal from the detection sensor; and an alarm generation module adapted to generate an alarm if the unique audio signal is verified.

11 Claims, 6 Drawing Sheets

| Parameter | Value | Unit |
|---|---|---|
| A/D Reference Voltage | 5.00 | Volts |
| Low Battery Threshold | 2.57 | Volts |
| Alarm Quiescent Level | 2.4 - 2.5 | Volts |
| Minimum Trigger Time | 100 | mSec |
| False Trigger Guard Time | 60 - 80 | mSec |
| Key Fob Data Encoding Rate | 750 - 850 | Hz |

*Fig. 5*

ALARM APPARATUS AND METHOD

RELATED APPLICATION

This application claims the benefit of United Kingdom patent application no. 0820143.6 filed Nov. 3, 2008, the entire disclosure of which is herein incorporated by reference.

FIELD OF THE INVENTION

The present invention relates to improvements in or relating to an alarm apparatus and method.

BACKGROUND OF THE INVENTION

Increasing crime rates have led to growing demand for security and alarm systems. Traditional security systems use a variety of sensors for detecting intrusions into a secured area. They include, for example magnetic sensors, infra-red (IR) sensors, pressure pads and break sensors etc. IR sensors have limited use in security systems since an intruder must actually enter a building, before his entry is detected. Furthermore, rapid temperature changes can sometimes trigger a false alarm response from an IR sensor. Similarly, in order to provide adequate protection, IR sensors must be fitted to all the entry and exit points in a building; and all the sensors coupled to a central control panel. Thus, considerable costs are incurred in purchasing and fitting IR sensors; and connecting all the sensors to the central control panel. Furthermore, the wiring associated with these connections can often be aesthetically unpleasing.

In the case of magnetic sensors, these sensors must be fitted to all doors and windows in a building and be connected to a central control panel. Thus, magnetic sensors are subject to similar cost and aesthetic disadvantages to the IR sensors. Pressure pad sensors are typically only fitted to main entry and exit points within a building, thus these sensors have limited use, as an intruder must actually enter a building to activate the sensors. Similarly, pressure pad sensors must be connected to a central control panel. In the case of vibration sensors, the performance of these sensors can be affected by the presence of birds, traffic, the ambient moisture levels in a building, etc. Furthermore, in order to provide adequate protection, vibration sensors must be fitted to all of the windows in a building; and connected to a central control panel.

Whilst it is recognised that for complete protection of the perimeter of a building, it is necessary to fit sensors to all of the doors and windows in the building, in practice standard security systems typically only employ magnetic sensors fitted to entrance doorways and infra-red sensors fitted at key positions in the building.

SUMMARY OF THE INVENTION

According to a first aspect of the invention there is provided an alarm system for protecting an environment from an unwanted events, such as an intrusion, the alarm system including: a detection sensor for detecting sound in the environment, wherein the detection sensors are adaptable to identify a unique audio signal if an unwanted event is detected; a sensor module adapted to verify the unique audio signal from the detection sensor; and an alarm generation module adapted to generate an alarm if the unique audio signal is verified.

Preferably, the unique audio signal has a predetermined profile.

Preferably, the detection sensor is remote from the sensor module and the detection sensor generates the unique audio signal corresponding to the unwanted events for transmission to the sensor module.

Also preferably, the unique audio signal is emitted from the detector module using an output device associated with the detector module.

Preferably, the system includes a recorder for recording a unique audio signal to identify a predetermined unwanted event.

Advantageously the sensor module includes a receiver for receiving the unique audio signal.

Also advantageously the sensor module and the alarm generation module are a single module.

Preferably the alarm generation module includes one or more alarm output means for outputting an alarm.

Advantageously the alarm output means include an audio, visual or audio-visual output.

According to a second aspect of the present invention there is provided a detection module for use in an alarm system for use in environment, wherein the detector modules are adaptable to produce a unique audio signal if an unwanted event is detected, which unique audio signal is adaptable to be received by a sensor module to produce an alarm when the unique audio signal is verified.

According to a third aspect of the present invention there is provided a sensor module for use in an alarm system for protecting an environment from an unwanted event wherein the sensor module is adapted to receive and verify a unique audio signal if an unwanted event is detected and to generate an alarm.

A preferred embodiment employs a single sensor which enables the detection of the opening of any door or window in a building. Thus, the preferred embodiment enables the detection of an intruder entering through any window or door, from one central point in the building.

A preferred embodiment uses an audio signal as a communication medium for notifying the sensor of the opening of a door/window in the building. Thus, it is no longer necessary to employ the costly, complex and often unsightly wiring between the plurality of sensors and a central control box in the prior art security systems.

Furthermore, in view of the inherent simplicity and robustness of the communication mechanism, it is possible to employ the invention in an environment, fixed or movable (e.g. to prevent unauthorised access to a fixed building, such as a house, or a portable property, such as a briefcase).

Furthermore, the apparatus of the preferred embodiment is connectable to the central control panels of prior art security systems.

BRIEF DESCRIPTION OF THE DRAWINGS

An embodiment of the invention is herein described by way of example, with reference to the accompanying drawings in which:

FIG. 5 is a table of operating parameters for the apparatus of FIGS. 1 and 2.

DETAILED DESCRIPTION

Figure 1:
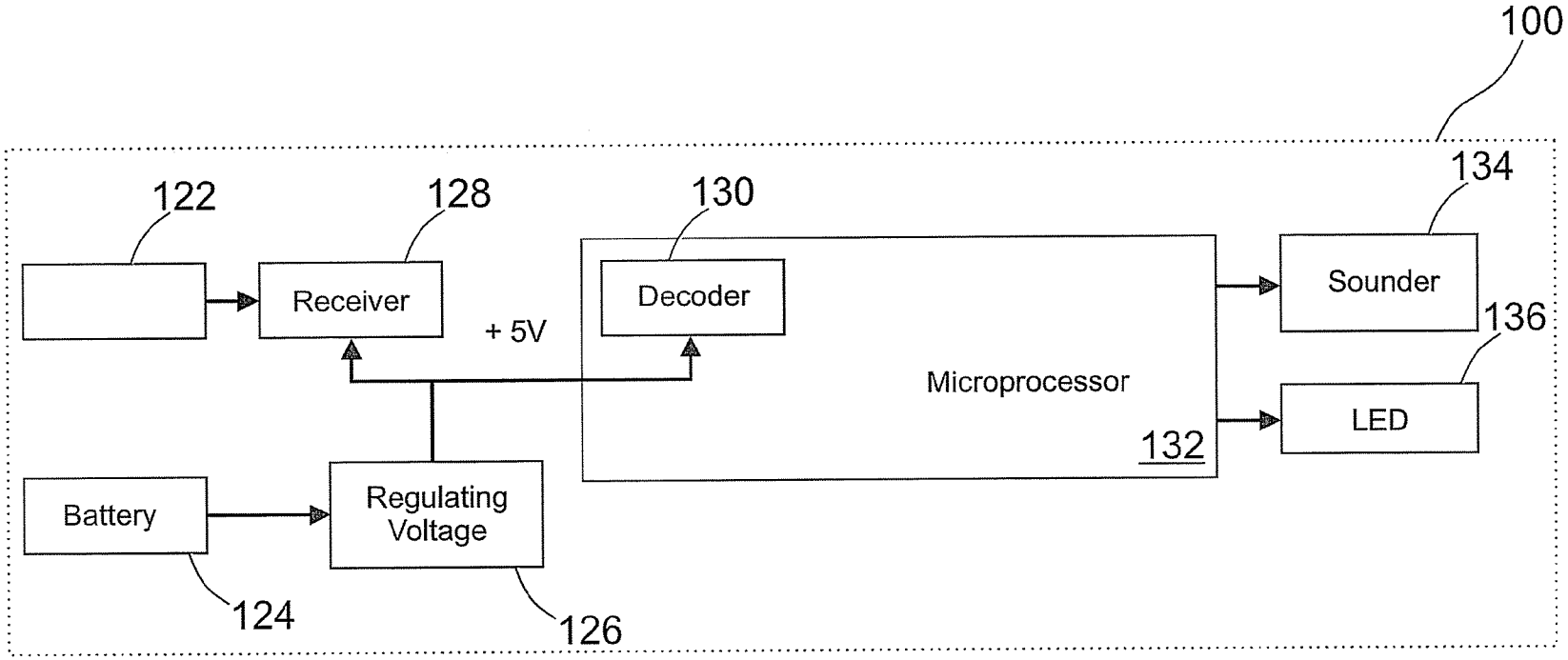
FIG. 1 is a block diagram of the apparatus of one embodiment.

Referring to FIG. 1, a first embodiment of an alarm system is shown. The alarm system includes a single sensor module 100 which includes a microphone 122. The microphone 122 is connected to a receiver 128, which in turn is connected to a decoder 130 in a microprocessor 132. The receiver 128 and the microphone 122 are provided with a voltage 126 by means of a battery 124 or any other appropriate power source. The microprocessor 132 is connected to a sounder 134 and a light emitting diode (LED) 136. The receiver can be any appropriate device, whether in hardware or software. In one embodiment the receiver may include a quad operational amplifier (quad op amp).

The alarm system can be located in any environment where an unwanted event may occur and where the unwanted event can be recognised by the alarm system of the present invention. The nature of the unwanted event and the manner in which it is recognised is an important part of the present invention as will be described below. The environment could be a building or any other entity where an alarm could be used to indicate the existence of an unwanted event. The term building includes property, dwellings, premises, enclosures or any other location with one or more means of entry thereto. The term is not intended to be limitative in any way. In addition the invention may apply to alarms for other articles, such as cars, suitcases, luggage, doors generally, opening generally, etc.

The alarm may be positioned in an appropriate location in, or in the proximity of, the environment and the microphone 122 and receiver 128 may be activated. The microphone 122 can pick up sounds or any audio signal in the environment and transmit these to the receiver 128. The audio signals may relate to ambient background audio patterns or relate to any one or more "unique sound signatures", each of which identifies an unwanted event. The audio signal is then decoded by the decoder 130 within the microprocessor 132. Within a specific environment there will be one or more ambient background audio patterns and examples of these patterns or parameters associated therewith may be stored in a suitable memory location in the microprocessor. Similarly, there may be a number of "unique sound signatures", each of which identifies an unwanted event and may be also stored in the suitable memory location in the microprocessor.

When the sound is picked up by the microphone 122 and received by the microprocessor 132, a comparison is made between the sounds or parameters associated therewith picked up by the microphone and the sounds stored in memory location. If the comparison identifies that the sounds picked up is equivalent or similar to one of the "unique sound signatures" the system recognizes that an unwanted event has occurred. As a result the microprocessor 132 can activate the sounder 134 and/or the LED 136 to generate an alarm.

The "unique sound signature" for an unwanted event may be determined on a general basis. For example, the opening of the door has a specific signature and the signature may be stored on all systems. Alternatively, the "unique sound signature" for an unwanted event may be recorded in situ in the environment and thereafter stored in the memory location. In this way the system can be customised to suit user needs and enable specific environment sounds and sound signatures to be determined and stored. This ability to customise and store "unique sound signatures" provides a number of advantages in that it allows a simple but highly efficient system to be used to detect specific sounds in a specific environment. It will be appreciated that "unique sound signatures" for any unwanted event can be determined and may include the change in sound of something which comes about as a result of the unwanted event. Depending on the sensitivity of the microphone the unique sound signature can have a very low amplitude and volume.

In a similar way, background ambient sound patterns can also be determined on a general basis or customised by recording the background noise in a particular environment. Again the sounds can be stored either as a general feature in the system or as a result of the customisation set up where the background noise is recorded. For both the "unique sound signatures" and the background ambient sound patterns experiments can be carried out to determine the general basis of these patterns and signatures. These experiments will include measuring the required sounds a number of times in order to determine an average pattern or signature.

Figure 2:
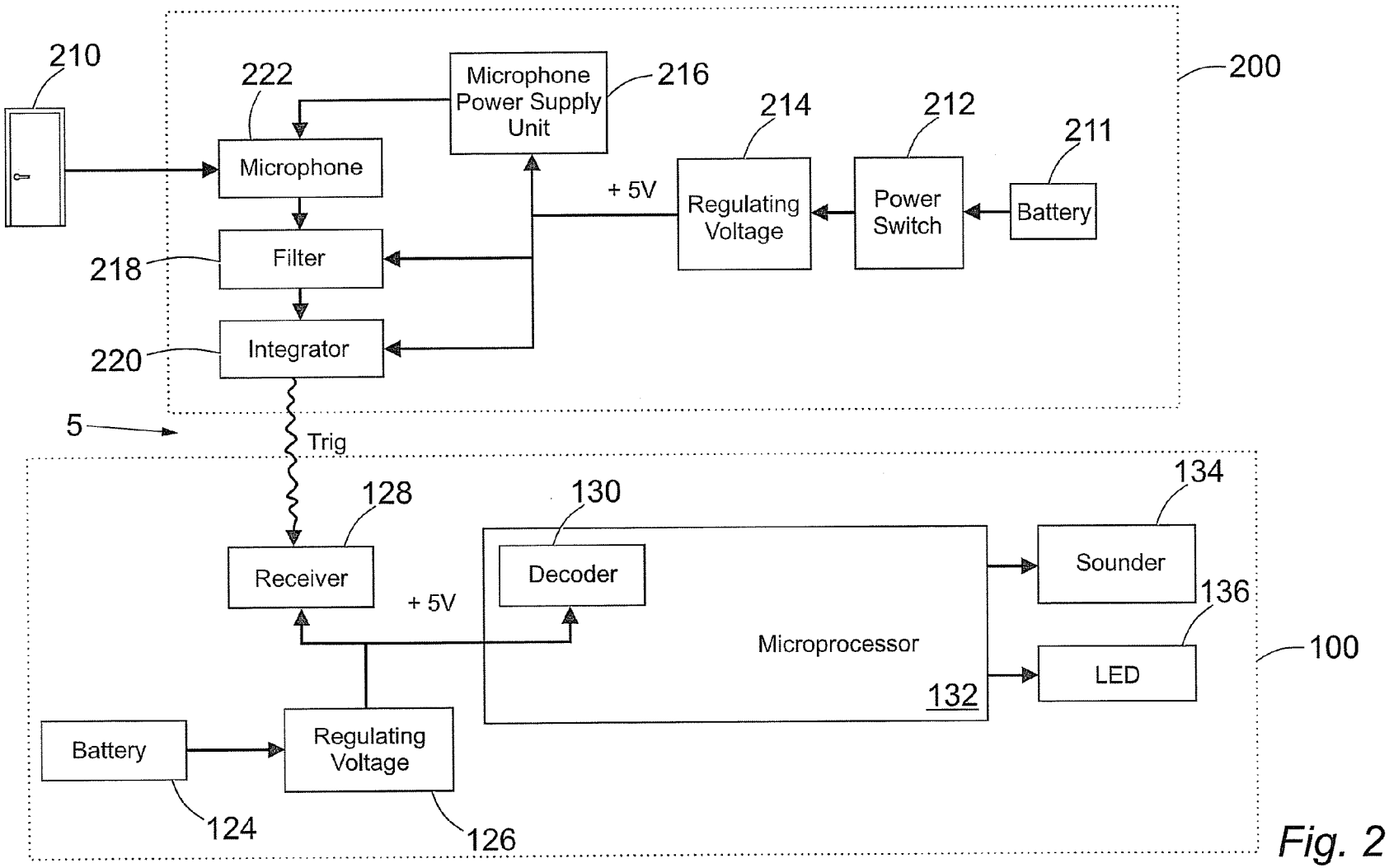
FIG. 2 is a block diagram of the apparatus of a second embodiment.

Referring to FIG. 2, the alarm system 10 of a further embodiment comprises a single sensor module 100 and a one or more transducer or detector modules 200. In use, the sensor module 100 is installed within a building to be protected; and the or each transducer modules 200 are coupled to the doors and/or windows 210 in a building. Alternatively the opening and closing of the doors and/or windows may generate the sound signatures.

The transducer or detector module 200 comprises a battery 211 coupled to a power switch 212 which is in turn coupled to a primary regulating voltage source 214. In the present example, the primary regulating voltage source 214 provides a supply voltage of +5V. However, it will be realised that the transducer module 200 of the preferred embodiment is not limited to this particular regulating voltage. In particular, the transducer module 200 is operable with any suitable voltage or voltage source.

In use, the primary regulating voltage source 214 supplies a regulating voltage to a microphone power supply unit 216, a filter 218 (which may be in the form of an op amp) and an integrator 220. The microphone power supply unit 216, in turn, supplies power to a microphone 222. The microphone 222 is coupled to an opening detector (not shown, e.g. electrical contact switch) which detects the opening of the corresponding door 210 or window in the building. In use, the opening of the door 210 or window is detected by the opening detector and an electrical or sound signal is transmitted therefrom to the microphone 222, to cause the microphone 222 to emit an audio signal. The electrical signal is processed by the filter 218 and the integrator 220 to produce a unique triggering audio signal (TRIG) for emission by the microphone 222. The nature of the unique triggering audio signal is described in greater detail below. Similarly the opening and closing of the door or window may directly generate the unique sound signal which is detected and this means that the generation of the TRIG signal by the integrator is not required.

The sensor module 100 of a preferred embodiment comprises a battery 124 coupled to a secondary regulating voltage source 126. In the present example, the secondary regulating voltage source 126 provides a supply voltage of +5V. However, it will be realised that the sensor module 100 of the preferred embodiment is not limited to this particular regulating voltage. In particular, the sensor module 100 is operable with any suitable voltage or voltage source.

The secondary regulating voltage source 126 is coupled to a receiver 128 and a decoder module 130, wherein the decoder module 130 is provided within a microprocessor 132 in the sensor module 100. The microprocessor 132 is further coupled with a sounder 34 and a one or more light emitting diodes (LEDs) 136. A sounder is a device that outputs a sound and the LED outputs a visual output. Any other type of device may be used to output the required warning or alarm to a user. On receipt of an audio signal by the receiver 128, the receiver 128 transmits the audio signal to the decoder module 130. On receipt of the audio signal, the decoder module 130 compares the received signal with a record (not shown) of the unique triggering audio signal (TRIG) and determines whether the received signal matches the unique triggering signal (TRIG). In this way, the unique triggering signal is verified. In the event the decoder module 130 determines that the received signal matches the unique triggering audio signal (TRIG), the microprocessor 132 issues an instruction to the sounder 134 and/or the or each LEDs 136 to issue visual and/or audio warnings to a user that a sensor has been triggered.

Figure 3A:
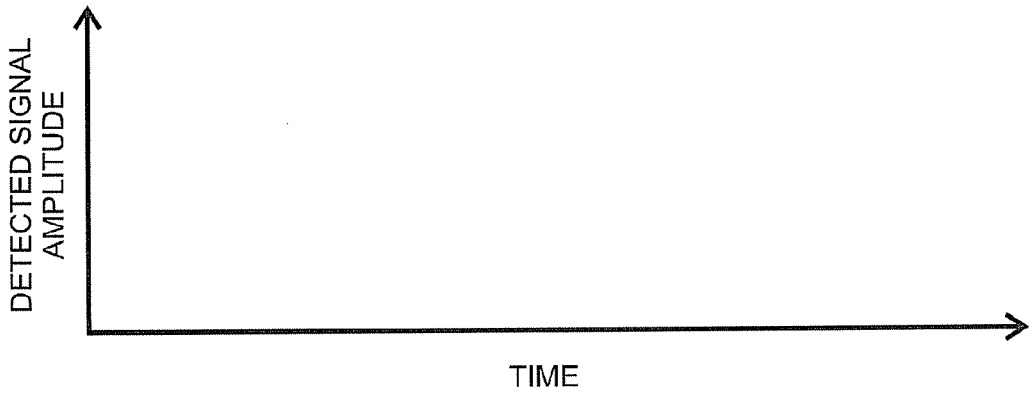
FIGS. 3 *a, b* and *c* are a number of waveforms of audio signals to explain the operation of the apparatus shown in FIG. 1 or FIG. 2.
Figure 3B:
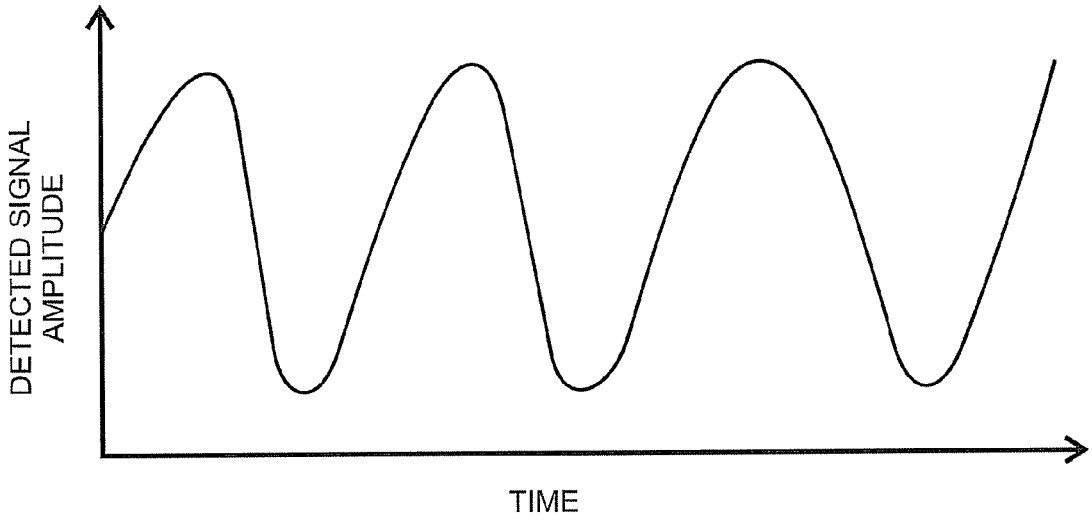

Referring to FIG. 3*a* in combination with FIG. 1 or FIG. 2, in the event the doors/windows in the building are unopened, the microphone 122 or 222 produces substantially no output or audio signal. In this state the audio signal detected by the receiver 128 in the sensor module 100, has a nominal amplitude. The sounds from the routine opening and closing of internal doors between rooms in the building may result in a net sound wave of a substantially periodic and smooth profile as depicted in FIG. 3*b*.

Figure 3C:
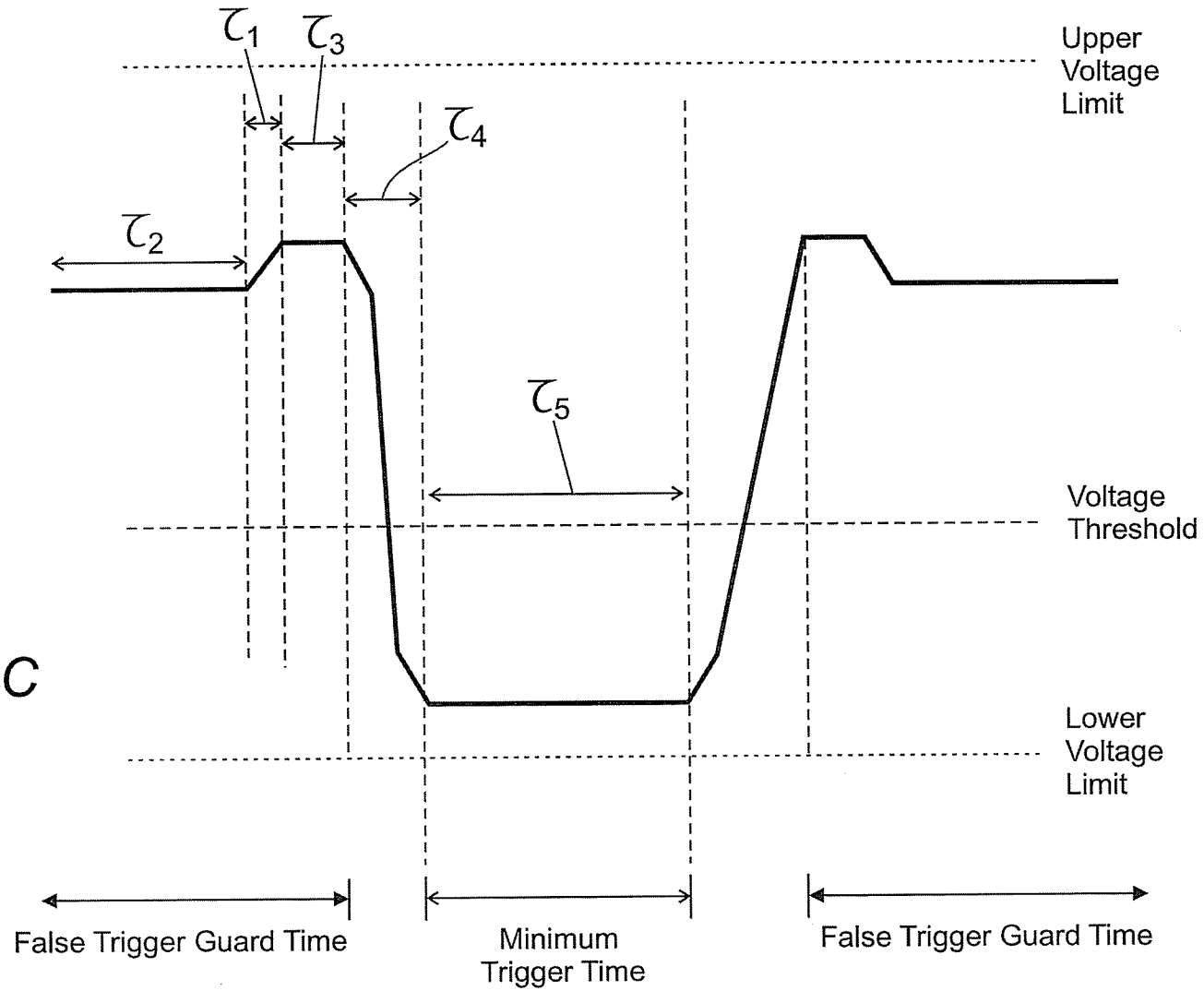

FIG. 3*c* shows the profile of the unique audio triggering signal emitted by the microphone in the transducer module 200 of a preferred embodiment in the event of an intrusion. The unique audio triggering signal is identified by the detection of a rising portion of duration $\tau_1$ in a received audio signal at the detector in the sensor module. On detection of this rising portion, the received audio signal is checked for a primary plateau region, which is higher than a predefined threshold voltage of duration $\tau_3$. Subsequently a decreasing signal portion of duration $\tau_4$ should occur. The received audio signal is then checked for a secondary plateau region of duration $\tau_5$ which represents a minimum trigger time and which is below the voltage threshold.

Further confirmation of the identity of the unique audio triggering signal may be provided by the mirror image of the previously described profile over respective time intervals $\tau_4$, $\tau_3$ and $\tau_1$ at the end of the secondary plateau region. The durations of the rising, primary plateau, decreasing and secondary plateau regions ($\tau_1$, $\tau_3$, $\tau_4$ and $\tau_5$) may be user-configurable and may be unique for each system.

In the unique audio triggering signal the rising portion of time interval $\tau_1$ is preceded by a substantially flat portion. The duration ($\tau_2$) of this flat portion represents a false trigger guard time which reduces the risk of false alarms by enabling the decoder to distinguish between a genuine unique audio triggering signal and multiple repeating audio signals resulting from, for example, rattling doors or window frames. Thus, on detecting a signal profile which substantially matches that of the unique audio triggering signal, a further retrospective analysis of a received audio signal is performed, to check for the presence of a flat portion of duration $\tau_2$, immediately preceding the rising portion of duration $\tau_1$. The alarm is only activated if the unique audio triggering signal is detected without any other trigger signals, within the false trigger guide time interval. A further false trigger guide time interval may be included after the mirroring rising portion of duration $\tau_1$; and a similar false alarm checking mechanism may be performed using this further false trigger guide time interval.

The unique audio signal may be user defined by means of an audio signal having a different profile, different type, etc. In addition, different sensors in different parts of a building may emit different audio signals. The sensor module may then identify the precise signal and identify not only that there is an intrusion, but also the exact location of that intrusion. The sensor module may require a memory and processor to facilitate this and may also include a more complex means of altering the trigger than a single sounder and single LED.

Figure 4:
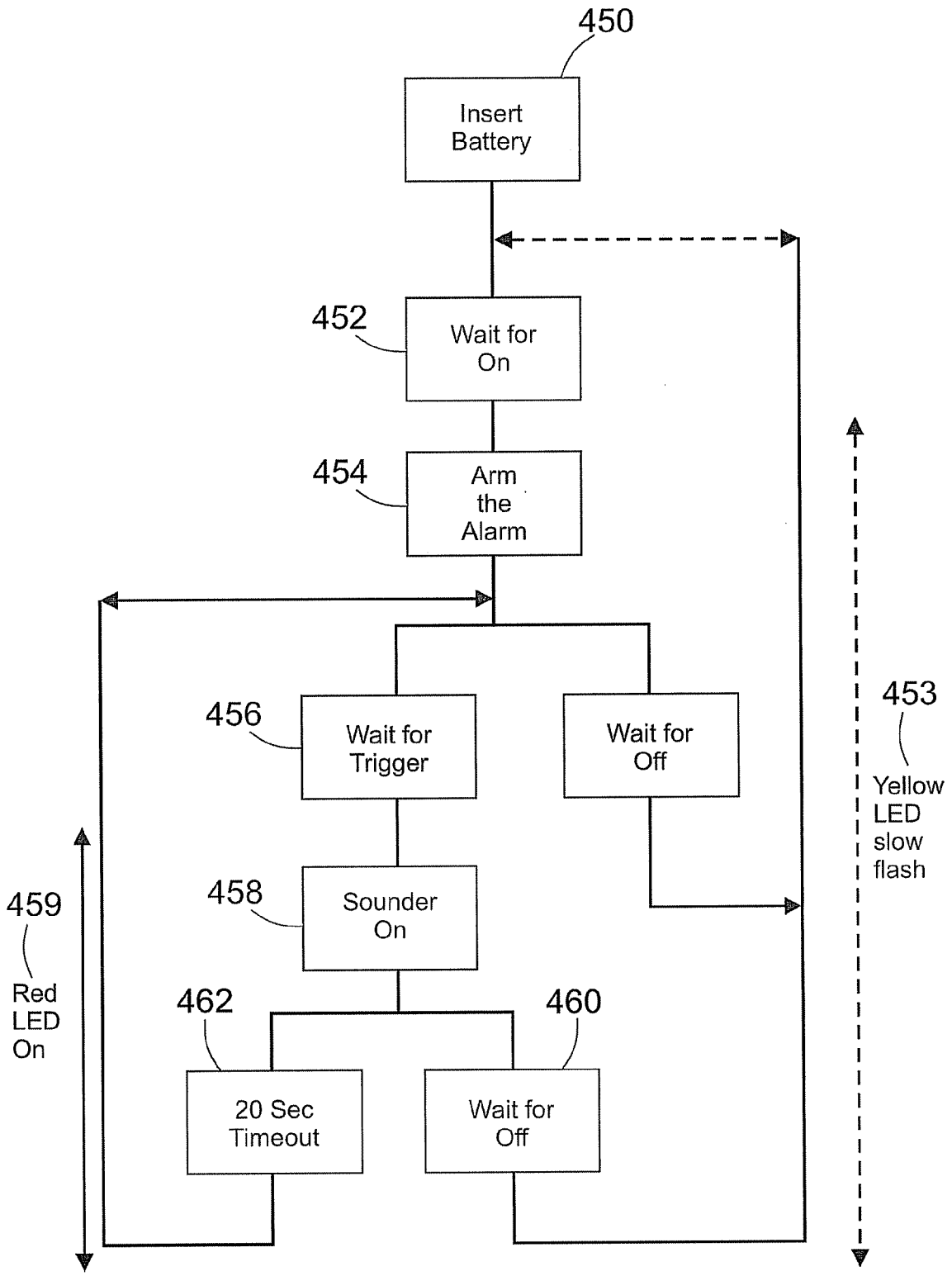
FIG. 4 is a flowchart of the method steps of a preferred embodiment.

Referring to FIG. 4, the method steps are now described. The user inserts the batteries into the sensor module and transducer modules of the security apparatus. The method of an embodiment then comprises the step of waiting for an on signal 452. On receipt of an on signal, the method of a preferred embodiment comprises the step of arming the alarm 454. This means the alarm system is now protecting the building from any intrusions. From the moment the system is armed a yellow LED flashes slowly on the sensor module to indicate the alarm is active 453. After the alarm has been armed it will remain in this state until a further event occurs. One event is the de-arming of the alarm which is indicated when a "wait for off" state 455 is satisfied. The alarm is then de-armed and returns to the "wait for on" state 452. Another event could be a trigger event (for example an intrusion), which is detected by the "wait for trigger" 456 in the sensor module. Once a trigger has been received and verified the sounder is switched on 458. When the sounder is activated, the LED changes to a permanent red light 459. The sounder may "time out" after a specific delay 462. An example is 20 seconds, after which time the alarm re-arms. The sounder may also be deactivated by a user switching off the system ("wait for off" 460 is satisfied) by entering a code or whatever. The alarm is then de-armed and returns to the state of "wait for on" 452 to be satisfied again.

A further event which is not shown in FIG. 4 is the possibility of a false trigger. This will be detected as described above and the sounder will not be activated. After detection of a false trigger the alarm returns to the armed state.

It will be appreciated that the method steps in FIG. 4 and the associated description will vary slightly for the embodiment where the microphone forms part of the alarm system and there is not a separate sensor module and transducer module. In addition there will not be a trigger signal, but instead a "unique sound signature" for the or each unwanted event. It is not shown in a separate diagram that the differences will be clear to the person skilled in the art.

For each embodiment a set of input parameters that are processed by the software within the microprocessor 132 are shown in FIG. 5. This table is intended solely as an example of various parameters and trigger levels which may be used in operation of the present invention. However, it will be appreciated that other parameters may be valid in other situations.

Alterations and modifications may be made to the above without departing from the scope of the invention.

It should be noted that the invention has been implemented in hardware although it will be appreciated that each hardware module may be replaced by an equivalent software module running on a computer or processor.

There are a number of advantages associated with the invention as will be apparent from the description above. A particular advantage that is worthy of mention is the fact that the system of the present invention is essentially wire free. The audio signal acting as a trigger and avoids the need for wiring and/or other communication means which can be aesthetically unpleasant. In addition, by use of simple audio equipment the whole system can be inexpensively implemented with a very simple installation.

What is claimed is:

1. An alarm system for protecting an environment from an unwanted event, the alarm system including: a detection sensor for detecting sound in the environment, wherein the detection sensor comprises an opening detector for detecting the unwanted event and an electrical or sound signal is transmitted from the opening detector to a microphone for emitting an audio signal, if the unwanted event is detected, to a filter which is connected to an integrator to produce a unique audio signal, wherein the unique audio signal is transmitted to a sensor module adapted to verify the unique audio signal from the detection sensor; and an alarm generation module adapted to generate an alarm if the unique audio signal is verified, wherein verifying the unique audio signal includes utilizing a false trigger guide time interval preceding or following the unique audio signal such that the unique audio signal is indicated as a false trigger if any audio triggering signal is detected within the false trigger guide time interval, wherein the sensor module identifies a location associated with the unwanted event using the unique audio signal.

2. The system of claim 1, wherein the unique audio signal has a predetermined profile.

3. The system of claim 1, wherein the detection sensor is remote from the sensor module and the detection sensor generates the unique audio signal corresponding to the unwanted event for transmission to the sensor module.

4. The system of claim 1, wherein the unique audio signal is emitted from the detection sensor using an output device associated with the detection sensor.

5. The system of claim 1, further comprising a recorder for recording a unique audio signal to identify a predetermined unwanted event.

6. The system of claim 1, wherein the sensor module includes a receiver for receiving the unique audio signal.

7. The system of claim 1, wherein the sensor module and the alarm generation module are a single module.

8. The system of claim 1, wherein the alarm generation module includes at least one alarm output means for outputting an alarm.

9. The system of claim 1, wherein the at least one alarm output means include an audio, visual or audio-visual output.

10. A detection module for use in an alarm system for use in an environment, wherein the detection module comprises an opening detector for an unwanted event and a microphone for emitting an audio signal if the unwanted event is detected and a filter and integrator to produce a unique audio signal, wherein the unique audio signal is adaptable to be received by a sensor module to produce an alarm when the unique audio signal is verified, wherein verifying the unique audio signal includes utilizing a false trigger guide time interval preceding or following the unique audio signal such that the unique audio signal is indicated as a false trigger if any audio triggering signal is detected within the false trigger guide time interval, wherein the sensor module identifies a location associated with the unwanted event using the unique audio signal.

11. A sensor module for use in an alarm system for protecting an environment from an unwanted event wherein the sensor module is adapted to receive and verify a unique audio signal produced by a filter and integrator if the unwanted event is detected and to generate an alarm if the unique audio signal is verified, wherein verifying the unique audio signal includes utilizing a false trigger guide time interval preceding or following the unique audio signal such that the unique audio signal is indicated as a false trigger if any audio triggering signal is detected within the false trigger guide time interval, wherein the sensor module identifies a location associated with the unwanted event using the unique audio signal.

* * * * *